US007207358B2

(12) United States Patent
Moreno-Jordana

(10) Patent No.: US 7,207,358 B2
(45) Date of Patent: Apr. 24, 2007

(54) SAFETY CUT-OFF FOR PRESSURIZED WATER VAPOR PRODUCTION DEVICES FOR DOMESTIC USE

(76) Inventor: Luis Moreno-Jordana, Artapadura, 11, Vitoria, Alava (ES) 01013

( * ) Notice: Subject to any disclaimer, the term of this patent is extended or adjusted under 35 U.S.C. 154(b) by 0 days.

(21) Appl. No.: 11/255,681

(22) Filed: Oct. 21, 2005

(65) Prior Publication Data

US 2006/0175435 A1 Aug. 10, 2006

(30) Foreign Application Priority Data

Oct. 22, 2004 (ES) ..... 200402527
Oct. 6, 2005 (ES) ..... 200502432

(51) Int. Cl.
*B65B 1/04* (2006.01)

(52) U.S. Cl. ..... 141/82; 141/301; 222/146.5; 219/432

(58) Field of Classification Search ..... 141/82, 141/301, 331, 98; 222/146.2, 146.4, 146.5; 219/429–436; 99/295–305
See application file for complete search history.

(56) References Cited

U.S. PATENT DOCUMENTS 3,865,277 A * 2/1975 Rimini ..... 222/146.5
4,274,588 A * 6/1981 Schwob ..... 239/138
5,490,448 A * 2/1996 Weller et al. ..... 99/305
7,091,455 B2 * 8/2006 Fung et al. ..... 219/432

* cited by examiner

*Primary Examiner*—Steven O. Douglas
(74) *Attorney, Agent, or Firm*—Knobbe, Martens, Olson & Bear LLP

(57) ABSTRACT

This invention relates to a safety cut-off for any type of device for domestic use which is designed to produce pressurized vapor for different purposes. The invention also relates to a safety cut-off for any type of device for domestic use which is designed to produce pressurized steam for different purposes, such as to avoid the risk of accidents by scalding when filling with water, when pressurized steam exists in the steam chamber.

6 Claims, 6 Drawing Sheets

SAFETY CUT-OFF FOR PRESSURIZED WATER VAPOR PRODUCTION DEVICES FOR DOMESTIC USE

FIELD OF THE INVENTION

This invention relates to a safety cut-off for any type of device for domestic use which is designed to produce pressurised vapour for different purposes. The invention also relates to a safety cut-off for any type of device for domestic use which is designed to produce pressurised steam for different purposes, such as to avoid the risk of accidents by scalding when filling with water, when pressurised steam exists in the steam chamber.

PRIOR STATE OF THE ART

In the field of this invention, at present there exist devices wherein the access to fill and refill with water the boiler in which the pressurised vapour will be produced is by means of a screw stopper in which a safety valve is incorporated.

This system has various disadvantages. The most important, in terms of the risk which it involves for the physical safety of people, consists in the danger of accidental scalding which the user may sustain when refilling the device with water, if the person concerned is not aware that the device is functioning and contains pressurised water vapour which will be projected towards the user when the stopper is removed, or is simply loosened; the stopper itself may even be projected against the user, as if it were a projectile.

Another disadvantage consists in the fact that in order to guarantee efficient closure, the stopper has a wide screw thread which needs numerous turns in order to be screwed on and unscrewed; this is inconvenient and impractical.

EXPLANATION OF THE INVENTION AND ADVANTAGES

In view of this situation, the present invention proposes a safety cut-off for pressurised water vapour production devices for domestic use, which complies with a particular composition consisting of a folding top which is disposed in closing/opening relationship with the access to a funnel through which the water must be poured for filling and refilling of the boiler in which the steam is produced, which top has a top shaft in relation with which there rotates a cam which is integral with the top, and which has an active periphery which is applied to a camshaft which is incorporated in a lever which can rotate relative to a lever shaft, and which, spaced from the latter, has an aperture through which there slides vertically a rod, which at its lower end incorporates a filling valve which is interposed between the funnel and a chamber for output of the steam produced in the boiler, which filling valve can adopt two, upper and lower operative positions such that, in the upper position, the filling valve acts as a shutter seat on the lower plane of a valve passage which puts this funnel into communication with the said output chamber, and, in the lower position, the filling valve is separated from this seat, the lever of which has a spring associated with it, and can oscillate between two, upper and lower operative positions, such that, in the lower position, this spring is in its state of greatest relative tension, and the contact between the camshaft of the lever and the cam of the top takes place on a part of this cam with a larger radius than that which is provided by the open position of the top, and in the upper position, the spring is in its state of greatest relative relaxation, and the contact between this camshaft and cam takes place on a part of this cam with a smaller radius than that which is provided by the closed position of the top, and, in the upper part of this valve passage, the said rod passes through the said aperture in the lever, and projects from an outer part on which there exists a flange which has a size larger than the diameter of this aperture, and on which there is supported the lower end of a helical compression spring which is weaker than the said spring which is associated with the lever, and which impels a said lower position of the filling valve in which this flange remains against the said aperture and the lever occupies its said lower position.

This closure arrangement provides functionality which ensures prevention of the above-described risk of accidents. In fact, the combined configuration of a folding top cam and lever camshaft means that when the top is open, the lower position of the lever is forced against the spring which impels its upper position, such that the action of the helical spring (which impels the lower position of the water filling valve), together with the weight of this filling valve itself, means that the filling valve effectively occupies this lower position which permits passage of the water to the boiler through the valve passage; on the other hand, the position in which the folding top is closed gives rise to relaxing of the spring, which, when it recovers resiliently, leads to raising of the rod, and thus of the filling valve, by means of the action of the aperture in the lever on the flange of the rod, which takes place by means of compression of the helical spring, and provides the position of closure of the water filling valve. When the filling valve is closed, the pressure of the water vapour generated in the boiler maintains this situation of closure even if someone opens the top to carry out refilling, without realising that there is pressurised water vapour in the device; this means that the top can be opened in any circumstance without any danger of the pressurised water being able to be projected towards the user, who remains protected against the risk of accidental scalding; in this situation, the lower position of the lever is compatible with the upper position (of closure) of the valve for filling with water and closure, since the rod of the latter passes freely through its aperture, and it is only when the rod and lever are in their lower positions that the raising of the lever also draws the rod such that its flange cannot pass through the aperture in the lever, as previously described.

Another advantageous quality of the invention consists in the ease and convenience of access which, for the filling with water, presupposes the action of opening/closure of a folding top, compared with the unscrewing and subsequent re-screwing of a stopper which requires many turns in order to provide safe and efficient closure. In this respect, and for greater convenience, another feature of the invention is that on its free edge the top has a thumb grip which facilitates its handling.

Another feature of the invention is that in parallel with the said filling valve, there exists a safety valve which is interposed between the funnel and the said output chamber.

The present invention also relates to a particular composition consisting of a folding top which is disposed in closing/opening relationship with the access to a funnel through which the water must be poured for filling and refilling of the boiler in which the steam is produced, which top has a top shaft in relation with which there rotates a cam which is integral with the top, and which has an active periphery which is applied to a camshaft which is incorporated in a lever which can rotate relative to a lever shaft, and which, spaced from the latter, has an aperture through which there slides vertically a rod, which at its lower end incorporates a filling valve which is interposed between the funnel and a chamber for output of the steam produced in the boiler, which filling valve can adopt two, upper and lower operative positions, such that, in the upper position, the filling valve acts as a shutter seat on the lower plane of a valve passage which puts the funnel into communication with the output chamber, and, in the lower position, the filling valve is separated from the seat, the lever of which has a spring associated with it, and can oscillate between two, upper and lower operative positions, such that, in the lower position, this spring is in its state of greatest relative relaxation, and the contact between the camshaft of the lever and the cam of the top takes place on a part of this cam with a larger radius than that which is provided by the open position of the top, and in the upper position, the spring is in its state of greatest relative compression, and the contact between this camshaft and cam takes place on a part of this cam with a smaller radius than that which is provided by the closed position of the top, and, in the upper part of this valve passage, the rod passes through the aperture in the lever, and projects from an outer part on which there exists a flange which has a size larger than the diameter of this aperture, and on which there is supported the lower end of a helical compression spring which is weaker than the spring which is associated with the lever, and which impels the lever to its upper position, and, consequently, the flange of the rod then settles on the aperture in the lever.

This composition ensures that, when the top is raised and pressurised steam exists in the steam chamber, the valve for filling and closure will remain closed, thus preventing steam from escaping and scalding the user. However, it does not include any means which gives visual warning of the existence of pressure in the steam chamber, even though the steam cannot be ejected onto the user. Nor does it include any means which prevents the steam generated by the residual heat in the steam chamber from rising when filling with water is carried out.

In view of this situation, the invention proposes a solution according to which, at its upper end, the rod is extended by means of an extension which at its tip incorporates an ostentatious colour, and is guided in a hole which communicates with the funnel closed by the top; with reference to the position of opening, or the lower position, and the position of closure, or the upper position, of the valve for filling with water and closure, the extension occupies respective lower and upper positions such that, in the lower position, its coloured tip is retracted in the hole, whereas, in the upper position, this tip penetrates in a cavity which is formed in a transparent cover located in the funnel.

The functioning of this solution is apparent. When there is insufficient pressure in the steam chamber for the valve for filling and closure to be closed (a safety feature pre-established in the characteristics of the helical spring which is associated with its rod), this valve will be open, and thus, the extension of the rod will be retracted and its coloured tip will not be seen through the viewer constituted by the transparent cover located in the funnel of the device. On the other hand, when steam pressure in excess of the safety limit exists, the valve will be closed, and the ostentatious coloured tip of the rod will have penetrated into the cavity in the viewer, and, when the top is raised, it will be clearly visible by the user, and will indicate to the latter that it is not yet possible to proceed to refill the steam chamber with water.

Another object of the present invention consists in that, between the valve passage and the lever, there is interposed a plate, the size of the periphery of which is designed to leave a channel of communication with the funnel, which, although it is narrow, allows the water to access the steam chamber.

This solution is specifically designed to prevent the steam produced spontaneously when filling with cold water whilst the steam chamber is still hot from recent previous use from being able to escape to the exterior and be projected onto the user when pressurised steam exists in the steam chamber, which steam will startle the user but not injure him, unlike the previous situation, which is now avoided.

These and other features of the invention are made apparent in the following graphic description.

DRAWINGS AND REFERENCES

In order to understand better the nature of the present invention, the attached drawings represent a preferred form of an industrial embodiment, the nature of which is purely illustrative and non-limiting.

Figure 1:
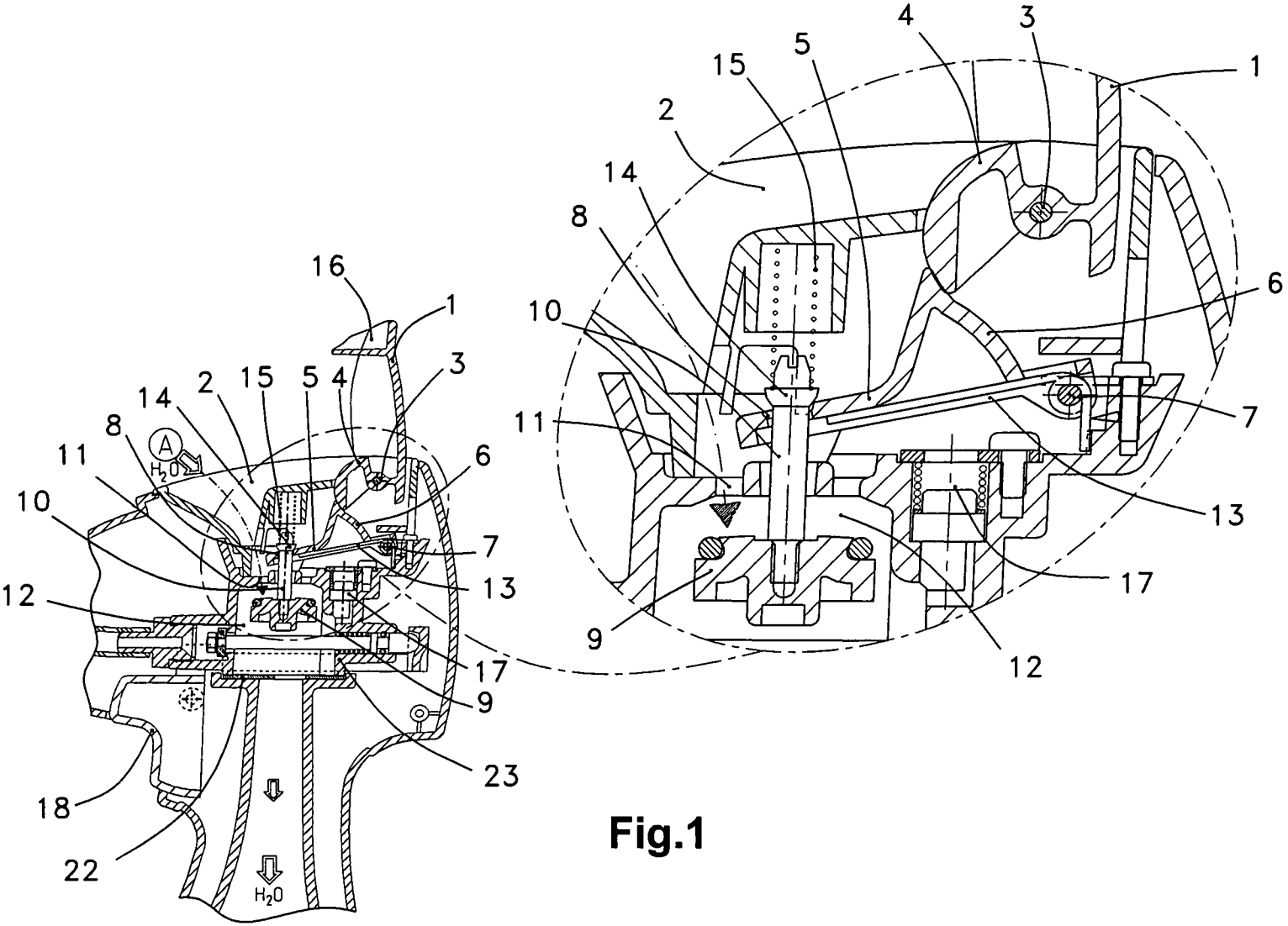
FIG. 1 shows in cross-section a device for production of pressurised water vapour for domestic use, which is provided with a folding top 1 according to the invention. This figure incorporates an enlarged detail of the device, in the position in which the top 1 is open.

These figures indicate the references indicated below:

1. Folding top
2. Funnel
3. Top (1) shaft
4. Top (1) cam
5. Lever
6. Lever (5) camshaft
7. Lever (5) shaft
8. Lever (5) aperture
9. Water filling and closure valve
10. Water filling and closure valve (9) rod
11. Valve passage
12. Steam chamber
13. Torsion spring
14. Rod (10) flange
15. Helical compression spring
16. Thumb grip
17. Safety valve
18. Trigger
19. Trigger thruster
20. Steam output valve shaft
21. Closure seat for steam output valve shaft (20)
22. Water retention seal
23. Support for the safety closure assembly.
10.1. Rod (10) extension
24. Viewer hole which communicates with the funnel (2)

25. Funnel (2) transparent cover or viewer
25.1. Transparent cover (25) cavity
26. Plate between valve passage (11) and lever (5)

DESCRIPTION OF A PREFERRED EMBODIMENT

With reference to the drawings and references listed above, the attached figures illustrate a preferred embodiment of the invention, relating to a safety cut-off for devices for production of pressurised water vapour for domestic use.

The purpose of the invention is to avoid scalding and other possible damage which can be caused by the devices known hitherto in this field, when the user inadvertently proceeds to fill the boiler with water, without realising that the device is functioning, and contains pressurised water vapour in its interior; in such cases, the present solution for closure by means of a threaded stopper does not provide safety for the user, since when the stopper is loosened pressurised water vapour begins to rise towards the user, or the stopper can even rise, launched as if it were a projectile.

In view of this problem, the solution according to the present invention consists (FIG. 1) of a folding top 1 which is disposed in closing/opening relationship with the access to a funnel 2 through which the water must be poured for filling and refilling of the boiler in which the steam is produced, which top 1 has a top shaft 3 in relation with which there rotates a cam 4 which is integral with the top 1, and which has an active periphery which is applied to a camshaft 6 which is incorporated in a lever 5 which can rotate relative to a lever shaft 7, and which, spaced from the latter, has an aperture 8 through which there slides vertically a rod 10, which at its lower end incorporates a valve 9 for filling and closure, which is interposed between the funnel 2 and a chamber 12 for the steam produced in the boiler, which valve 9 for filling with water and closure can adopt two, upper and lower operative positions such that, in the upper position, the valve 9 for filling and closure acts as a shutter seat on the lower plane of a valve passage 11 which puts this funnel 2 into communication with the said steam chamber 12, and, in the lower position, the valve 9 for filling and closure is separated from this seat, the lever 6 of which has a torsion spring 13 associated with it, and can oscillate between two, upper and lower operative positions, such that, in the lower position, this torsion spring 13 is in its state of greatest relative tension, and the contact between the camshaft 6 of the lever 5 and the cam 4 of the top 1 takes place on a part of this cam 4 with a larger radius than that which is provided by the open position of the top 1, and in the upper position, the torsion spring 13 is in its state of greatest relative relaxation, and the contact between this camshaft 6 and cam 4 takes place on a part of this cam 4 with a smaller radius than that which is provided by the closed position of the top 1, and, in the upper part of this valve passage 11, the said rod 10 passes through the said aperture 8 in the lever 5, and projects from an end part on which there exists a flange 14 which has a size larger than the diameter of this aperture 8, and on which there is supported the lower end of a helical compression spring 15 which is weaker than the said torsion spring 13 which is associated with the lever 6, and which impels the filling and closure valve 9 to a lower position in which this flange 14 remains against the said aperture 8 and the lever 5 occupies its said lower position.

Figure 2:
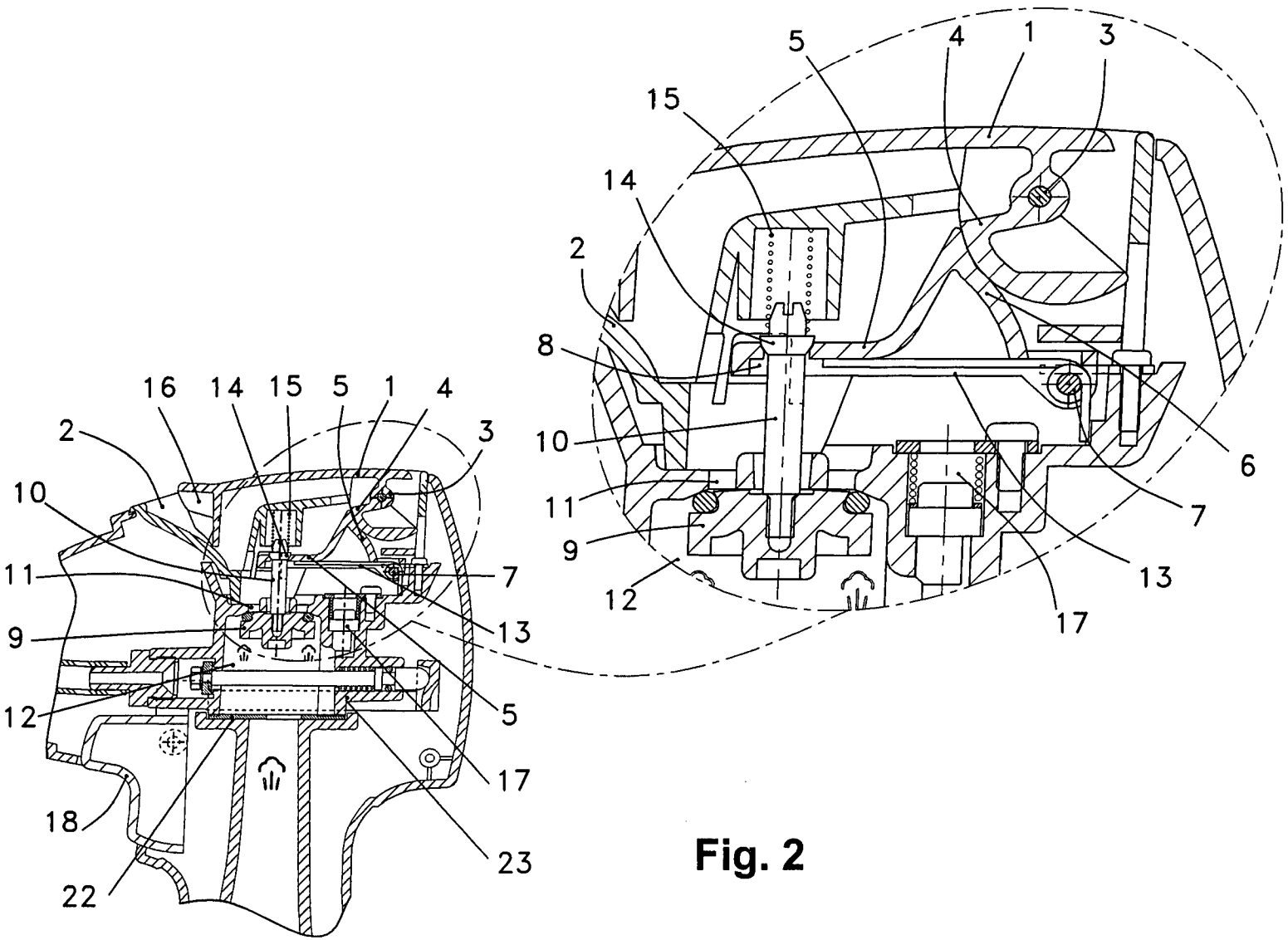
FIG. 2 is like FIG. 1, but relates to the closed position of the top 1.
Figure 3:
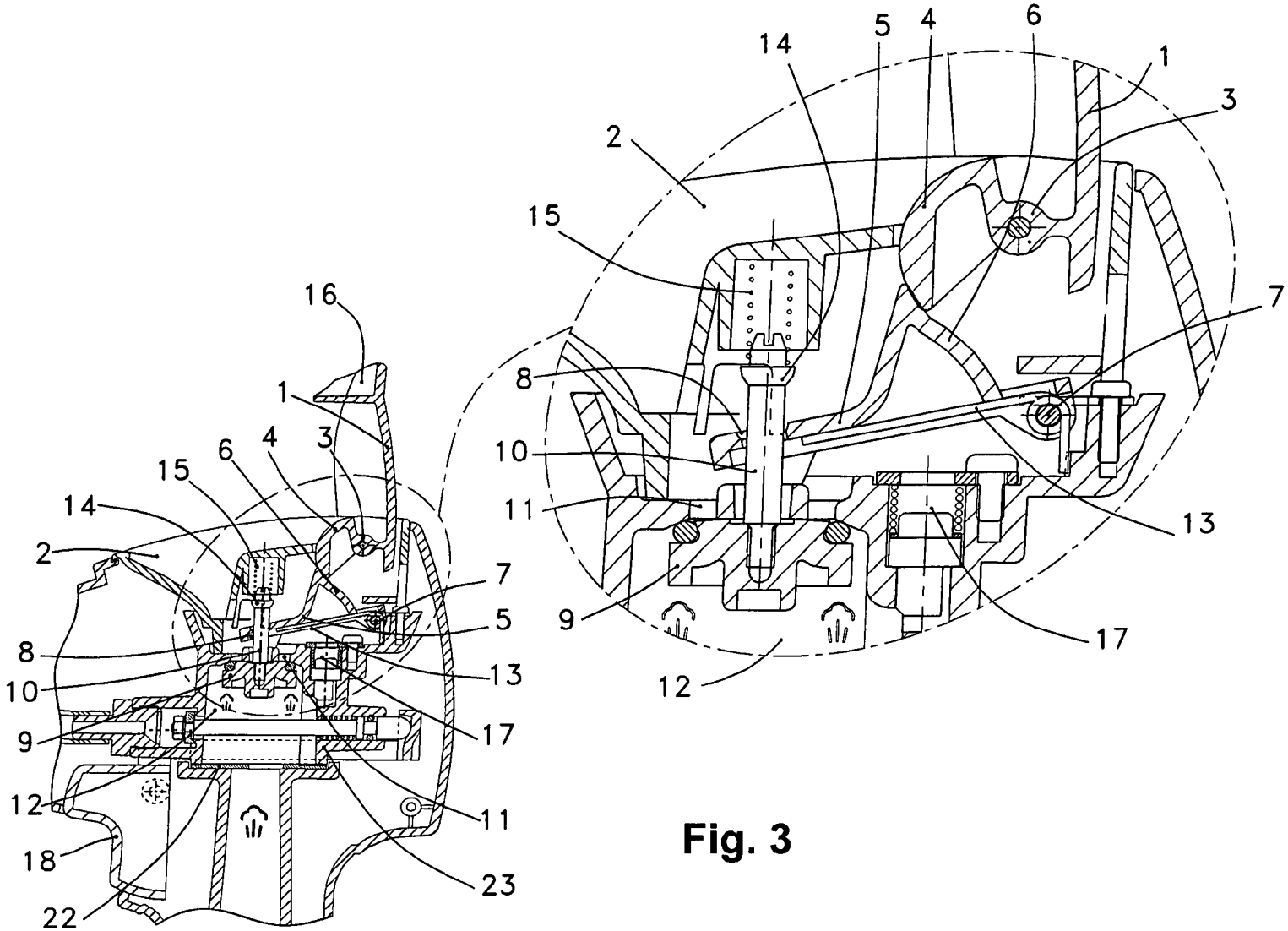
FIG. 3 is like FIG. 2, but with the top 1 open when there is water vapour pressure in the boiler.

FIGS. 1 to 3 illustrate the functionality of the device. In FIG. 1, the folding top 1 is open, and there is no steam pressure in the boiler; in this case, for the conjugated configuration of the cam 4 and the camshaft 6, the lever 5 occupies its lower position against the resilient action of the torsion spring 13, which in turn means that, by means of the action of the helical spring 15 and its own weight, the valve 9 for filling with water and closure occupies its lower position which is delimited by the abutment of the flange 14 of the rod 10 against the aperture 8 of the lever 5, which leaves the valve passage 11 free for filling the boiler with water. When the folding top 1 is closed (FIG. 2), this conjugated configuration of the cam 4 and camshaft 6 stops the pressure on the torsion spring 13, and its resilient recovery gives rise to transfer of the lever 5 to its upper position, drawing with it the rod 10 because of the action of the aperture 8 on the flange 14 of the latter. FIG. 3 illustrates the safety function wherein the folding top 1 can be opened without danger since the pressure itself of the water vapour ensures the closure of the valve 9 for filling with water and closure, providing a greatly reduced value of this vapour pressure, which in all cases is insufficient to cause any damage to the user.

The use itself of a folding top 1 instead of the present screw stopper presupposes considerable ease and convenience of handling, which is further increased by the fact that on its free edge the top 1 has a thumb grip 16 as can be seen in FIGS. 1 and 2.

FIG. 1 and the remaining figures show another feature of the invention, consisting of the fact that in parallel with the said valve 9 for filling with water and closure, there is a safety valve 17 which is interposed between the said funnel 2 and the said vapour chamber 12.

Figure 4:
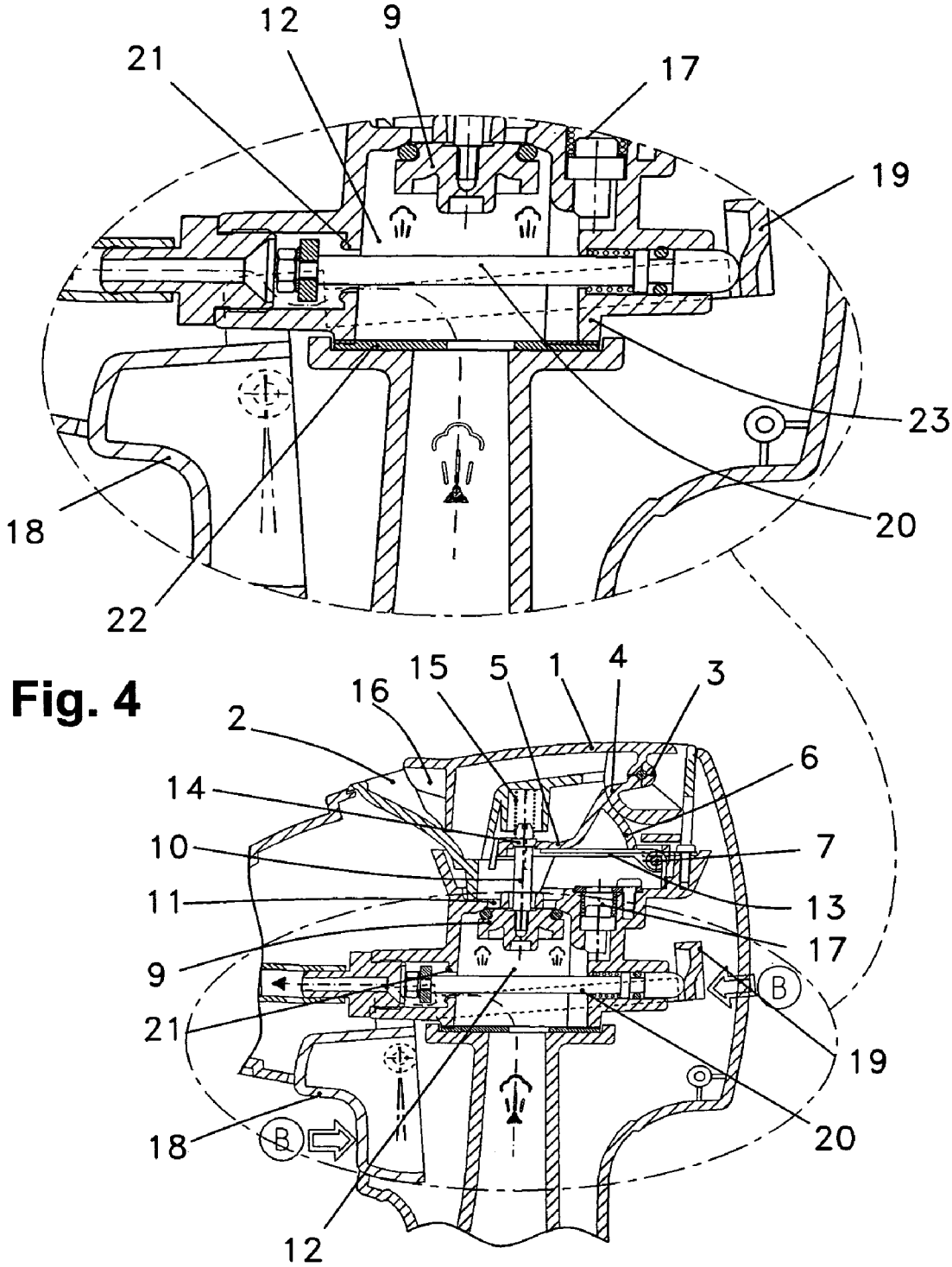
FIG. 4 is similar to the preceding figures, and represents the situation of functioning in the case of a pressurised water vapour spray gun, illustrating the action of firing, as can be seen clearly in the enlarged detail incorporated in the figure.

FIG. 4 illustrates the actuation for spraying of the pressurised water vapour produced, when the device for this purpose is of the gun type; in this case, when the trigger 18 is pressed, it acts on a thruster 19 which acts on the steam output valve shaft 20, separating the latter from its closure seat 21, and thus enabling the output of the pressurised water vapour for its use.

Figure 5:
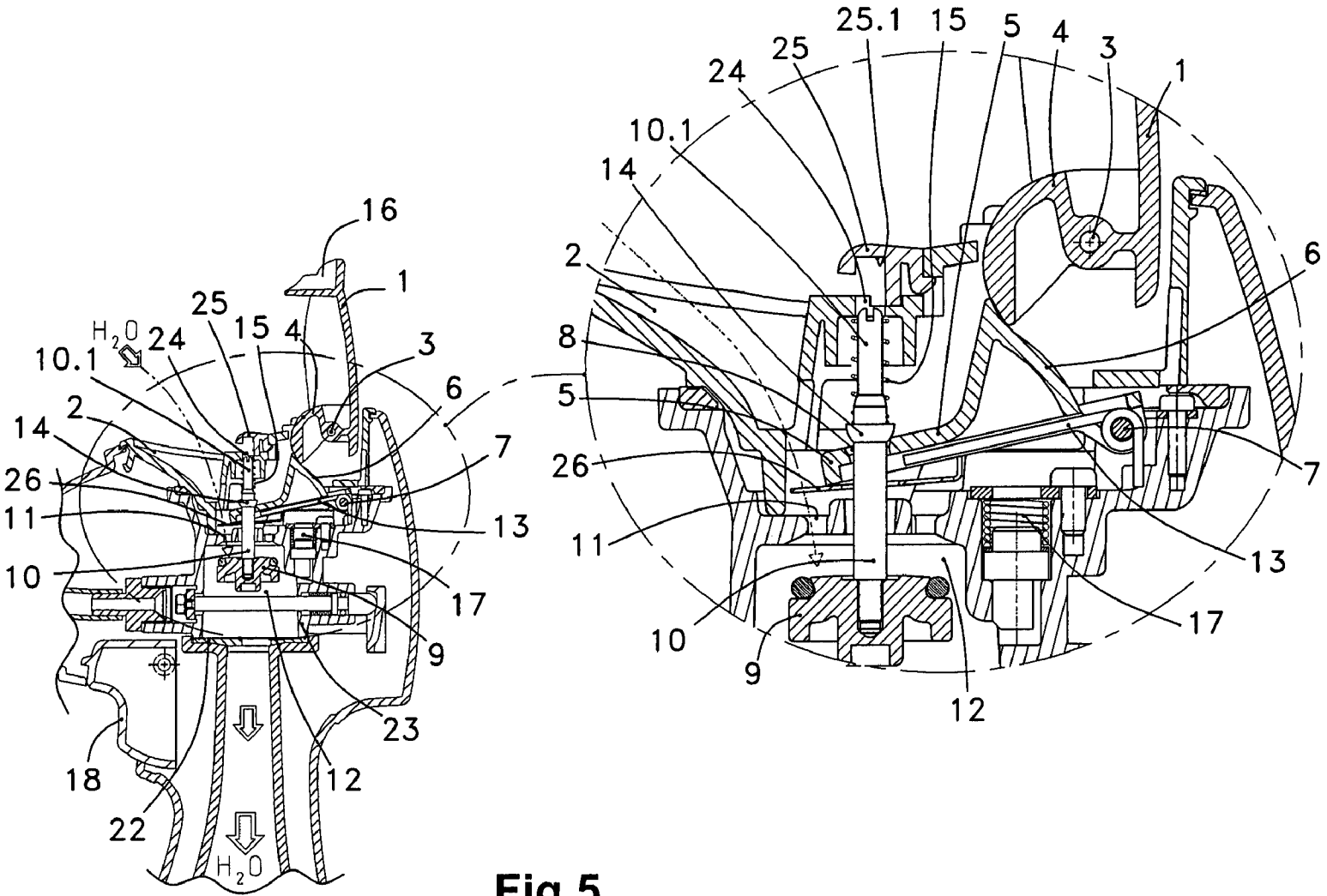
FIG. 5 is a view which illustrates the subject of this addition patent, by means of representation similar to that of FIG. 1 of the main patent of invention.

As shown in FIG. 5, at its upper end, the rod 10 is extended by means of an extension 10.1 which at its tip incorporates an ostentatious colour, and is guided in a hole 24 which communicates with the funnel 2 closed by the top 1; with reference to the position of opening, or the lower position, and the position of closure, or the upper position, of the valve 9 for filling with water and closure, the extension 10.1 occupies respective lower and upper positions such that, in the lower position, its coloured tip is retracted in the hole 24, whereas, in the upper position, this tip penetrates in a cavity 25.1 which is formed in a transparent cover 25 located in the funnel 2.

Figure 6:
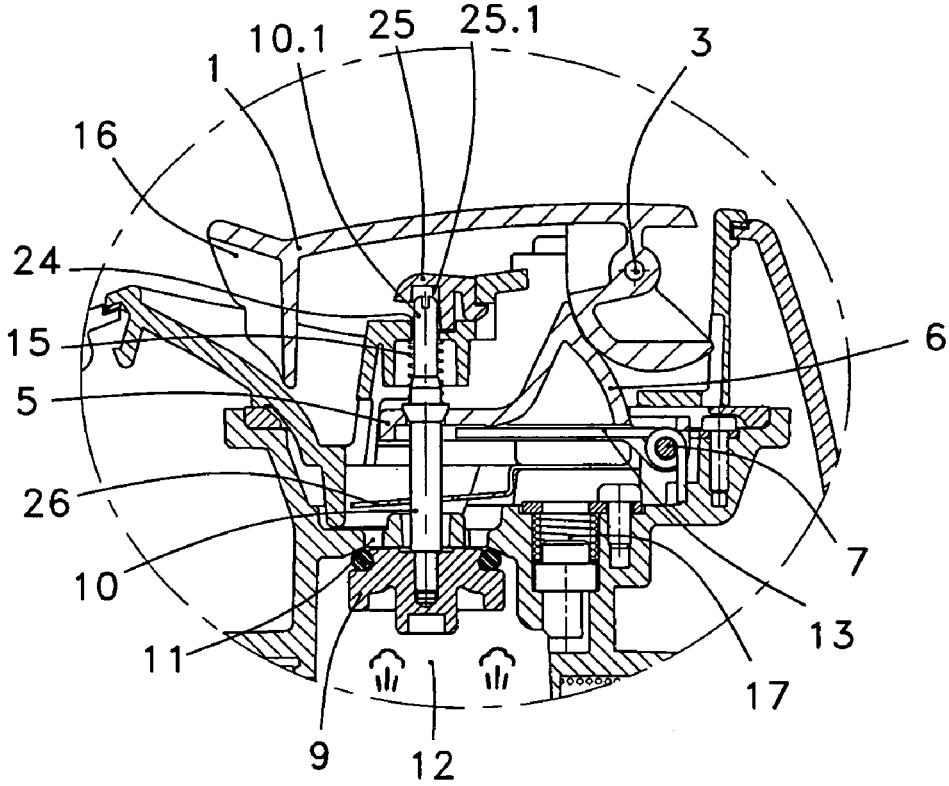
FIG. 6 is like FIG. 5, but relates to the position in which the top 1 is closed and pressure exists in the steam chamber 12.
Figure 7:
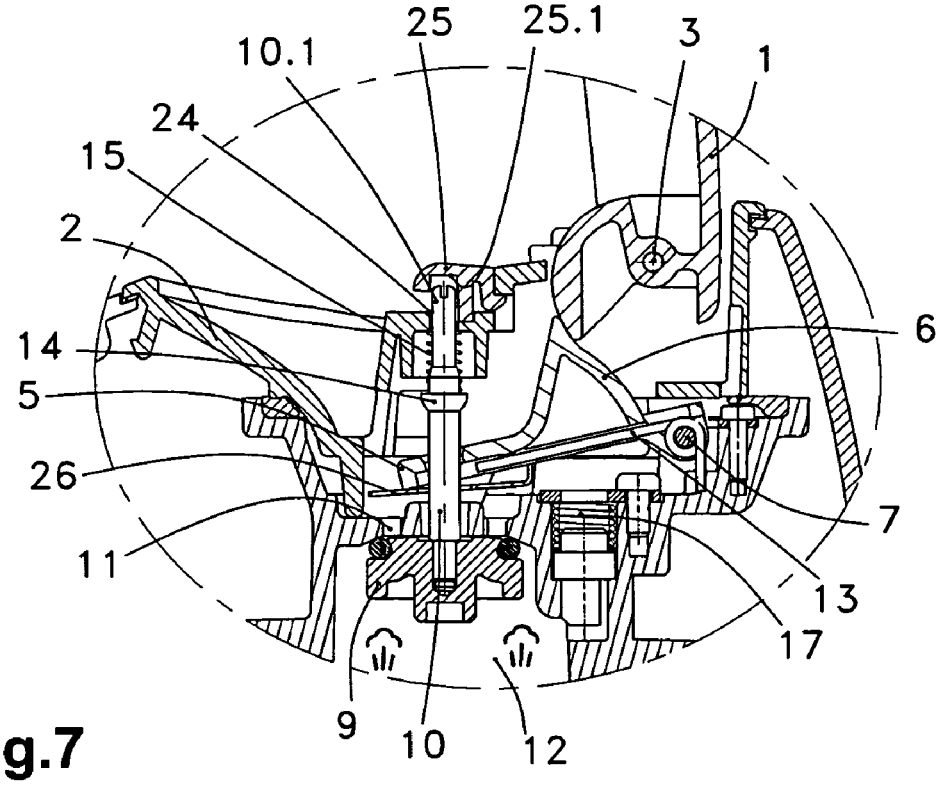
FIG. 7 is like FIG. 5, but relates to the position in which the top 1 is open and pressure exists in the steam chamber 12.

FIGS. 5 to 7 illustrate the different functioning situations. FIG. 5 shows the state in which the steam chamber 12 is without steam and cold, waiting to be filled with water in order to begin to work; it can be seen that the extension 10.1 of the rod 10 is retracted in the hole 24 and its coloured tip cannot be seen through the transparent cover 25 which acts as a viewer. When the steam chamber 12 has been filled with water the top 1 is closed, and when the equipment is connected up to the mains supply, the steam pressure begins to be sufficient (FIG. 7), and the extension 10.1 of the rod 10 slides through the hole 24 such that its ostentatious tip penetrates into the cavity 25.1 in the viewer constituted by the transparent cover 25. If the top 1 were raised in this situation, the coloured tip of the extension 10.1 of the rod 10 would now be clearly visible through the viewer 25, and the user would automatically be warned that it is impossible to carry out the filling of the steam chamber 12; this is indicated in FIG. 7. The actuation on the rod 10 which takes place when the top 1 is opened and closed, caused by the combined action of the cam 4 of the top 1 on the camshaft of the lever 5, has already been clearly described in the reference patent, and does not need to be repeated.

Another advantage of the present invention consists in that, between the valve passage 11 and the lever 5, there is interposed a plate 26, the size of the periphery of which is designed to leave a channel of communication with the funnel 2, which, although it is narrow, allows the water to access the steam chamber 12.

As illustrated by FIG. 5, this device makes it possible to prevent the steam from being projected dangerously towards the user when the steam chamber 12 is filled with cold water when it is open and empty, but still hot from recent use.

The invention claimed is:

1. Safety cut-off for devices for production of pressurised water vapour for domestic use, characterised in that it consists of a folding top (1) which is disposed in closing/opening relationship with the access to a funnel (2) through which the water must be poured for filling and refilling of the boiler in which the steam is produced, which top (1) has a top shaft (3) in relation with which there rotates a cam (4) which is integral with the top (1), and which has an active periphery which is applied to a camshaft (6) which is incorporated in a lever (5) which can rotate relative to a lever shaft (7), and which, spaced from the latter, has an aperture (8) through which there slides vertically a rod (10), which at its lower end incorporates a valve (9) for filling and closure, which is interposed between the funnel (2) and a chamber (12) for the steam produced in the boiler, which valve (9) for filling with water and closure can adopt two, upper and lower operative positions such that, in the upper position, the valve (9) for filling and closure acts as a shutter seat on the lower plane of a valve passage (11) which puts this funnel (2) into communication with the said steam chamber (12), and, in the lower position, the valve (9) for filling and closure is separated from this seat, the lever (6) of which has a torsion spring (13) associated with it, and can oscillate between two, upper and lower operative positions, such that, in the lower position, this torsion spring (13) is in its state of greatest relative tension, and the contact between the camshaft (6) of the lever (5) and the cam (4) of the top (1) takes place on a part of this cam (4) with a larger radius than that which is provided by the open position of the top (1), and in the upper position, the torsion spring (13) is in its state of greatest relative relaxation, and the contact between this camshaft (6) and cam (4) takes place on a part of this cam (4) with a smaller radius than that which is provided by the closed position of the top (1), and, in the upper part of this valve passage (11), the said rod (10) passes through the said aperture (8) in the lever (5), and projects from an end part on which there exists a flange (14) which has a size larger than the diameter of this aperture (8), and on which there is supported the lower end of a helical compression spring (15) which is weaker than the said torsion spring (13) which is associated with the lever (6), and which impels the filling and closure valve (9) to a lower position in which this flange (14) remains against the said aperture (8) and the lever (5) occupies its said lower position.

2. Safety cut-off for devices for production of pressurised water vapour for domestic use according to claim 1, characterised in that, on its free edge, the top (1) forms a thumb grip (16).

3. Safety cut-off for devices for production of pressurised water vapour for domestic use according to claim 1, characterised in that, in parallel with the said valve (9) for filling and closure, there is a safety valve (17) which is interposed between the said funnel (2) and the said steam chamber (12).

4. Safety cut-off for devices for production of pressurised water vapour for domestic use according to claim 1, characterised in that one such device for production of pressurized water vapour is a type that is a gun that has a water retention seal (22) which prevents water from being emitted from the boiler when the gun is positioned horizontally, such that only water vapour is emitted, and, in addition, this retention seal (22) in turn constitutes a sealing element between the boiler itself and the support of the safety cut-off.

5. Safety cut-off for devices for production of pressurised water vapour for domestic use according to claim 1, characterised in that, at its upper end, the rod (10) is extended by means of an extension (10.1) which at its tip incorporates an ostentatious colour, and is guided in a hole (24) which communicates with the funnel (2) closed by the top (1); with reference to the position of opening, or the lower position, and the position of closure, or the upper position, of the valve (9) for filling with water and closure, the extension (10.1) occupies respective lower and upper positions such that, in the lower position, its coloured tip is retracted in the hole (24), whereas, in the upper position, this tip penetrates in a cavity (25.1) which is formed in a transparent cover (25) located in the funnel (2).

6. Safety cut-off for devices for production of pressurised water vapour for domestic use according to claim 1, characterised in that, between the valve passage (11) and the lever (5), there is interposed a plate (26), the size of the periphery of which is designed to leave a channel of communication with the funnel (2), which, although it is narrow, allows the water to access the steam chamber (12), and prevents steam from being able to be projected dangerously towards the user when the steam chamber (12) is filled with cold water when it is open and empty, but still hot from recent use.

* * * * *